US006368213B1

(12) United States Patent
McNabola

(10) Patent No.: US 6,368,213 B1
(45) Date of Patent: Apr. 9, 2002

(54) MULTI-WAY KENO METHOD AND DEVICE

(76) Inventor: William D. McNabola, 140 Triberg St., Henderson, NV (US) 89014

( * ) Notice: Subject to any disclaimer, the term of this patent is extended or adjusted under 35 U.S.C. 154(b) by 0 days.

(21) Appl. No.: 09/482,495

(22) Filed: Jan. 13, 2000

Related U.S. Application Data

(60) Provisional application No. 60/116,248, filed on Jan. 13, 1999.

(51) Int. Cl.[7] ..... A63F 9/24
(52) U.S. Cl. ..... 463/18; 463/16
(58) Field of Search ..... 463/16, 17, 18, 463/19, 20, 21, 22, 25, 30, 31; 273/138.1, 274, 269, 139

(56) References Cited

U.S. PATENT DOCUMENTS 5,401,024 A * 3/1995 Simunek ..... 273/138 A
5,611,729 A * 3/1997 Schumacher et al. ..... 463/18
5,727,786 A * 3/1998 Weingardt ..... 273/269
5,788,240 A * 8/1998 Feinberg ..... 273/274
5,813,911 A * 9/1998 Margolin ..... 463/19
5,909,875 A * 6/1999 Weingardt ..... 273/269
5,935,001 A * 8/1999 Baba ..... 463/18

* cited by examiner

*Primary Examiner*—Jessica J. Harrison
*Assistant Examiner*—Kim T. Nguyen
(74) *Attorney, Agent, or Firm*—Quirk & Tratos

(57) ABSTRACT

The present invention relates to a multi-way Keno gaming device and method where a player can play a straight ticket with a desired number of spots or a straight ticket with a plurality of ways. The processor for the device controls a display to identify by color or otherwise the selected ways and further identifies king numbers which are included in two or more ways.

11 Claims, 2 Drawing Sheets

MULTI-WAY KENO METHOD AND DEVICE

This application claims the benefit of provisional application 60/116,248, filed Jan. 13, 1999.

FIELD OF THE INVENTION

The present invention relates to electronic Keno games.

BACKGROUND

Electronic video Keno is a known game where the player picks from one to ten numbers from a field of eighty numbers. The desired numbers are selected usually through touch-screen technology and are indicated on a grid to visually display the numbers selected. When the game begins, the processor for the electronic game randomly selects twenty numbers from the field of eighty numbers, 1–80, and the selected numbers are likewise displayed by the machine. There is a displayed paytable for each game and, depending on how many numbers of the player selected numbers match with the outcome numbers selected by the machine's processor, the player wins an amount based on the paytable or loses their wager. This type of "regular" ticket is commonly played for a given number of specific numbers and is referred to by the number of "spots" picked, such as, a "Four Spot" ticket when four numbers are picked by the player, a "Six Spot" when the player picks six numbers, and so on for any group of numbers from one to ten.

Unlike electronic Keno machines, live Keno games have been, for some time, also utilizing way tickets along with spot tickets. When a player plays a way ticket in live Keno, they mark their various selected "ways" by circling them on the ticket to identify each group of numbers comprising each way. The player then wagers an amount on each circled way, plus an amount on the total number of spots marked. In this manner, when the twenty numbers are drawn during the game, the player is actually betting on the game based upon the total numbers selected plus sub-games related to each way.

The electronic Keno machines have heretofore not been able to offer player selectable groups for true "way" wagering opportunities as offered by live Keno games. Many avid live Keno players enjoy playing "Way Tickets". A Keno way ticket is where the player picks multiple groups of numbers and plays several sub-sets of numbers as well as, for example, an "Eight Spot" ticket. This could consist of four "Two Spots Ways" plus the Eight Spot, or two "Four Spots Ways" plus the Eight Spot. Each of the "ways", as described above in relation to live Keno, are circled on the live Keno ticket to identify each way being played. The advantage of playing smaller sets of numbers is that they are easier to hit as a group than larger groups of numbers. While they do not pay as high as for higher numbers of spots, the increased hit frequency of the smaller groups "keeps you in the money" by giving back more frequent payoffs.

A player could just play a single "Two Spot" or "Three Spot" but the lower payoff amounts for these groups may not be exciting. However, when combined with also playing the larger Eight, Nine or Ten Spots including the "way sub-sets" the player has the opportunity for frequent award pays and a chance for a large jackpot.

There is a need for an electronic game device and method which enables players to identify and play "ways".

SUMMARY OF THE INVENTION

There is, therefore, set forth according to the present invention a device and method which permits a player of electronic Keno to select and play ways as well as the total number of numbers selected.

The device includes a video display and a processor to control the display. The processor is pre-programmed to include means for randomly selecting from the field of eighty Keno numbers, 1–80, an outcome set of twenty numbers and to control the display for the play of the game. Means for accepting a wager are provided to accept any form of wager such as by coin, cash, script, electronic funds transfer or the like.

The device includes means for the player to select (1) a total number set of numbers N to be wagered upon (usually 10 or less) and/or (2) one or more ways W1–$W_N$ each of which consists of a subset of the total number set N. These means may be by touch-screen technology where the player would touch the displayed matrix to select the numbers, a touch wand, keyboard or the like. For example, the player may pick a total number set of seven numbers (13,19,38, 56, 62, 70 and 80) and three ways W1 (13, 56, 62), W2 (19, 38, 56) and W3 (56, 70, 80). In response to the selection, the processor stores the numbers corresponding to each way W1–W3 and the total number set N and controls the display to visually identify which numbers are included in each way W1–W3. For example the matrix box or address including the selected numbers of each way may be highlighted or have a background of a discrete color or graphic presentation whereas the numbers for other ways have another distinguishing color or graphic presentation. Alternatively, the numbers for each way could simultaneously flash on the display out of phase with the flashing of the numbers of other ways. Still further, the display may include a table displayed adjacent to the matrix providing a listing of the numbers for each way.

Where a number is a king number, i,e, is a number commonly used in a plurality of ways, the processor can control the display to distinguish the king number from the selected ways. The processor may control the processor to display the king number at bisected or trisected and each section including the color of a corresponding way.

Accordingly, the present invention provides for the playing of ways at an electronic Keno machine which will increase the excitement and overall play of such games.

BRIEF DESCRIPTION OF THE DRAWINGS

These and other features and advantages will become better appreciated with reference to the description, claims and drawings wherein:

DESCRIPTION

Broadly the present invention enables electronic Keno machine players to play "ways" by creating groups of numbers by using color designations or graphical representations such as graphical patterns (such as dots, cross hatching, changing sizes, superscript or subscript designations, flashing animated figures or a separate table ) to designate and distinguish each way selected. By using, preferably, specific color backgrounds in association with each number selected for a way, the numbers of each way can be designated and identified.

Figure 1:
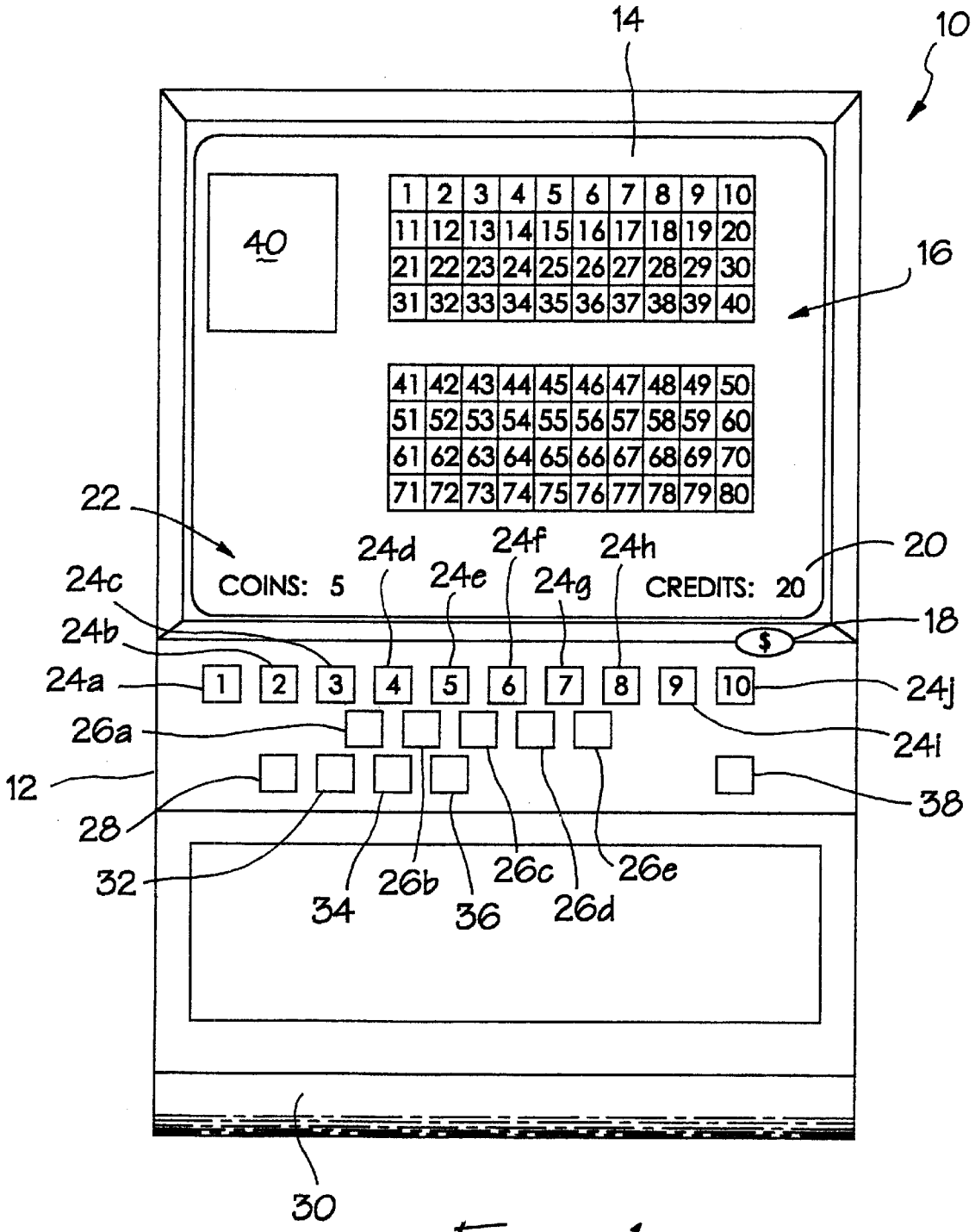
FIG. 1 shows a device having a display controlled for play of the game according to the present invention.

Turning to the drawings FIG. 1 shows an electronic device 10 for playing the game according to the method of the present invention. The electronic device 10 has a housing 12 mounting a video display 14 which is controlled by a processor (not shown) contained in the housing 12 to display a Keno number grid 16 showing numbers, one through eighty, and further indicates the numbers being wagered upon and selected as hereinafter described. The device 10 processor controls the various features and displays for the device 10 as hereinafter described.

The device also includes means for accepting a desired wager. The means for accepting a wager to play the game may be means for receiving coins or tokens such as a coin slot 18, a cash validator, debit card or the like for accumulating and wagering credits in a manner as is known in the art. The wager accepting means interfaces with the processor so that the processor can acknowledge and account for the input of the wager(s). The total amount of the credits available for wagering are displayed at credit meter 20 as is the number of wagers for each particular "hand" of play at a wager location 22.

To provide a means for the player to select the total number N of numbers on the grid 16 he wishes to play, disposed on the housing 12 are total number buttons 24*a–j* which may be numbered 1 thorough 10 as shown. By depressing any total number button 24*a–j* for the total number N of numbers on the Keno grid 16 which the player wishes to play, the processor is signaled to receive and process the number N of selections. For purposes of the example shown in the drawings, the player has depressed the total number button 24*a–j* corresponding to a total number N of seven numbers.

To provide a means to play "ways", the device 10 includes a plurality of way buttons 26*a–e* designated as "Group 1" through "Group 5", etc. Alternatively, the way buttons 26*a–e* could designated as "Way 1" though "Way 5". Each group selected by the player denotes a way $W_1$–$W_N$ to be played by the player. As described below, to play ways the player will depress the way buttons 26*a–e* in sequence and designate the numbers of each way (W).

To select the numbers on the Keno grid 16 to play, the device display 14 may be touch screen. Alternatively, as is known in the art, the device 10 may be provided with a wand (not shown) to touch the desired numbers to be played.

With continuing reference to FIG. 1, the device also includes means for controlling play and entering wagers. There is provided a collect button 28 which, as is known, if depressed controls the device to dispense accumulated credits into a tray 30 or to issue a credit slip or to otherwise cash out the player. A bet one button 32, if depressed, causes one credit to be wagered. A bet multiply button 34 controls the device to enter multiples of wagers. For example if a player wagers one unit on three ways and a total number (total wager is four units) as hereinafter described, depressing the bet multiply button 34 would increase the wager in multiples of four so that the player can incrementally raise the wagers being made. The erase button 36 enables the player to erase the prior game's selection to select new numbers and the start/repeat button 38 prompts the processor to begin the selection of an outcome, compare the outcome and, if it is a winning outcome, issue and award.

To play the game according to the method of the present invention, the player accumulates credits for wagering by depositing coins, cash debiting an account or, where the game is played as a novelty game, setting credits for wagering. As shown in FIG. 1 the player has twenty credits available for wagering as shown at the credit meter 20.

The player then selects the total number N of numbers he wishes to play by depressing a desired total number button 24*a–j*. In the example shown, the player has depressed total number button 24*g* to play a total number N of seven numbers. When the total number button 24*g* is selected the processor controls a light to illuminate the button 24*g* to confirm the selection. The processor is thereby provided with data corresponding to the total numbers to be played for this game. At the same time the Group 1 button 26*a* illuminates to prompt the player to make their first selection. The Group 1 button may be color coded, e.g. red, to correspond to the selections embraced by Group 1 selections. The player then selects numbers from the grid 16 for the first group by using a wand device or touch screen. If the player wishes to play a regular, or one way, total number N, ticket, he would pick the seven numbers which selections would be at least partially or show a background color corresponding to the Group 1 color (e.g. red) and depress the start/replay button 20. For ease of operation, the device would for each group or way selected automatically select a wager of one credit; however the player by depressing a bet multiply button 24 can wager more for each way. Again for ease of operation, the amount wagered for each way may be the same.

In the above example where the player has selected a regular or one way ticket and depressed the start/replay button, the processor would randomly select twenty numbers which would be displayed by illumination or marking of the outcome numbers in the grid 16. If a predetermined outcome numbers match the numbers selected the player receives a payoff otherwise the players wager is lost. The player may replay the ticket by depressing the start/replay button 20. In this fashion, the device 10 can be played in a manner consistent with conventional electronic Keno.

Figure 2:
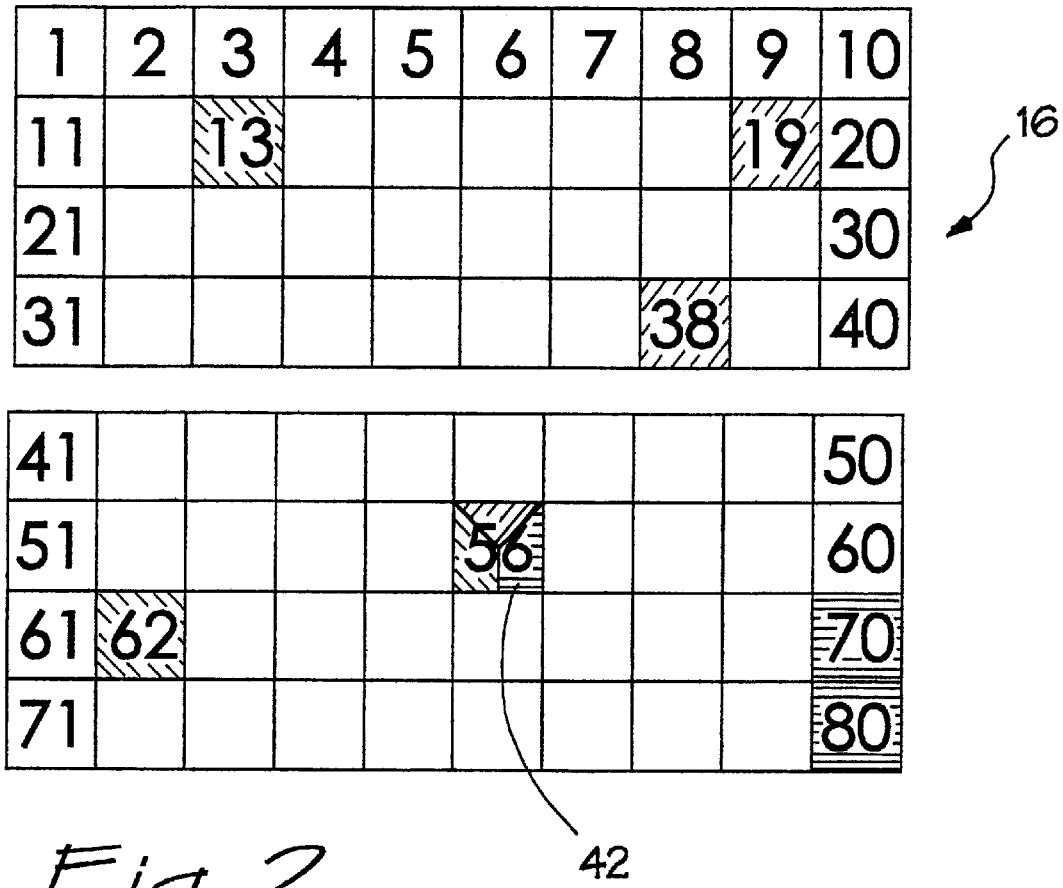
FIG. 2 shows the display with three selected ways according to the present invention.

With reference to the FIG. 2, the player has selected a total number N of seven numbers to be played. For the Group 1 selections he player selects several numbers such as the three numbers of 13, 56 and 62 as the first "way" (W1) numbers which have a background of red to identify the Group 1 numbers. At least one credit would be wagered for the Group 1 selections as well as another credit for the total number of seven numbers being played thereby deducting two credits from the credit meter 20. The player then depresses the Group 2 button 26*b* which illuminates in a different color, e.g. yellow, and the player makes the Group 2 (W2) selections (19,38,56) which would be highlighted or by designated by a background color of yellow to identify the numbers corresponding to the Group 2 selections. At least one additional credit would be wagered for Group 2 selections. The player then depresses the Group 3 button 26*c* which illuminates in a third color such a green and the player selects the three numbers (56, 70, 80) corresponding to the third way (W3) and which are identified by a background of green. An additional credit is wagered for the Group 3 selections. As described below, the player's selections of each of the three ways includes a common, or king, number 42 of 56.

Had the player not desired to use a king number 42 and wanted to play three ways (W1–W3) of three numbers each, he would have depressed the total number button 24*i* corresponding tp a total number N of 9 numbers and would have selected each of the three, three number ways W1–W3 in the manner described above.

During the selection, as each way of group is selected at least one credit is waged for each way. The processor monitors the credit inventory to make sure there are credits available for wagering. If the credits are exhausted, the processor will prompt the player to input more money or the player can cancel the selections and start over by depressing the erase button 26.

In the example shown in FIG. 2 the player has wagered one unit to play a (i) seven total number N ticket (numbers 13, 19, 38, 56, 62, 70 and 80), (ii) a three number way W1 represented by the Group 1 numbers (13, 56, 62), (iii) a three number way W2 represented by the Group 2 numbers (19, 38, 56) and (iv) a three number way W3 represented by the Group 3 numbers (56, 70, 80) for a total wager of four units. If desired, the player can wager more by depressing the bet multiply button 34. When all selections have been made the player depresses the start/repeat play button 20 whereupon the processor randomly selects from the field of eighty numbers (1–80) twenty outcome numbers. The outcome numbers are denoted on the grid 16 by check marks, circles, flashing backgrounds or the like as they are selected. The processor compares the outcome numbers to the selected numbers to determine the outcome(s) for the total number selection (13, 19, 38, 56, 62, 70, 80) and for each of the three, three number ways of Groups 1, 2 and 3. Each way is assessed separately as is the total number selection. If the player has more than a predetermined number of selected numbers in any of the three ways and/or for the total number selection, he receives a payout. A pay table 40 may be provided at the display 14 to inform the player of the numbers required for a winning outcome and the award for each winning outcome. The required number of corresponding outcome numbers and selection numbers, for each way or for the total number play, before a player receives an award are known for a seven number (often referred to as a seven spot) ticket as well as for each of the three spot ways.

The player can make the same play for another game by depressing the start/repeat play button 20.

Collect button 28 enables the player to cash out accumulated credits.

Figure 3:
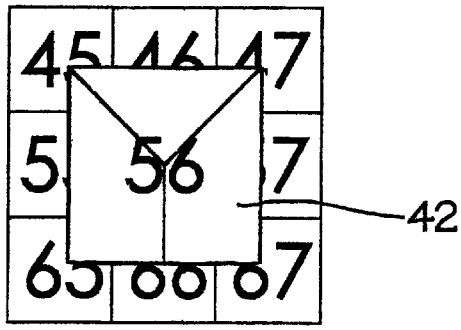
FIG. 3 shows the display controlled to distinguish a king number.

The present invention also provides for identifying and designating a king number. The king number is a selected number which is included in more than one way such as the number 56 in FIGS. 2 and 3. When the processor senses that a king number 56 is being used, it can control the display 14 to highlight the importance of this number. As shown the king number 56 can be displayed as enlarged and the background is trisected into three differently colored segments to identify that the number 56 is included in the Groups 1, 2 and 3. Alternatively, the king number 56 need not be enlarged. As an alternative, the king number could be controlled to sequentially flash through each of the colors red, yellow and green for each of the ways W1–W3, or Groups, in which it is included.

In lieu of using color codes for the ways W, each way W may be designated by other graphics such as patterns of lines or dots, animated characters or the like sufficient to designate and display the numbers selected for each way being played. The numbers for each way could also be controlled to flash in unison but out of sequence with the flashing of the numbers for the other ways. Alternatively, as each way is selected the display 14 may be controlled to provide a tabulation at the display 14 showing the numbers selected for each way.

Still further, the total number buttons 24*a–j*, way buttons 26*a–e* may be displayed on a touch screen display in lieu of providing buttons on the housing 12.

While I have shown and described certain embodiments of the present invention it is to be understood that it is subject to many changes and variations without departing from the spirit an scope of the appended claims.

I claim:

1. A device for playing an electronic Keno game including at least two ways comprising:

a display;

a processor to control the display, said processor including means for randomly selecting an outcome set of twenty numbers from a field of eighty numbers 1–80 and for controlling the display to display a Keno card defining a matrix of said field numbers;

means for accepting a wager;

selecting means for a player to select at the matrix (a) a total number N of numbers to be played and (b) a way defined by a subset W of numbers of N, said selecting means sending signals to the processor and said processor in response thereto (i) storing the numbers corresponding to N and W and (ii) controlling the display to distinguish the numbers of W from the numbers of N;

means for prompting play of the device, said processor in response to prompting play randomly selecting an outcome set and comparing said outcome set to the numbers of N and W; and means for issuing a reward to the player if a predetermined correspondence exists between the numbers of the outcome set and the numbers of N or W.

2. The device of claim 1 wherein said processor includes means for distinguishing between the numbers of N and W by controlling the display to display the numbers of W with a color different from that of the numbers of N.

3. A device for playing an electronic Keno game including at least two ways comprising:

a display;

a processor to control the display, said processor including means for randomly selecting an outcome set of twenty numbers from a field of eighty numbers 1–80 and for controlling the display to display a Keno card defining a matrix of said field numbers;

means for accepting a wager;

selecting means for a player to select (a) a first way W1 of numbers to be played, (b) a second way W2 of numbers, said numbers of ways W1 and W2 defining a set N of a total number of numbers being played, said selecting means sending signals to the processor and said processor in response thereto (i) storing the numbers of N and W1 and W2 and (ii) controlling the display to distinguish the numbers of way W1 from way W2;

means for prompting play of the device, said processor in response to prompting play randomly selecting an outcome set of numbers and comparing said outcome set to the numbers of ways W1, W2 and set N;

means for issuing a reward to the player if a predetermined correspondence exists between the number of numbers of the outcome set and the numbers in set N and ways W1, W2; and means for issuing a reward to the player if a predetermined correspondence exists between the number of number of the outcome set and the numbers in set N or ways W1, W2.

4. The device of claim 3 wherein said processor includes means for distinguishing the numbers of way W1 from way W2 by controlling the display to apply a different color to the numbers of way W1 from the color for the numbers of way W2.

5. The device of claim 4 including said processor including means to identify a number shared by way W1, W2 defining a king number and to control the display to apply a color to the king number to show that it is contained in both ways W1, W2.

6. The device of claim 5 wherein said controlling means controls the display to divide the king number into a number of portions and to apply in each portion the color of the including way W1, W2.

7. A method for playing a Keno game including ways comprising:

providing a processor to control a video display to display a Keno card having a field of numbers;

a player making a wager;

the player selecting at the display from the displayed field a first group of numbers defining a first way W1 and second group of numbers defining a second way W2, the processor controlling the display to visually distinguish the numbers of W1 from the numbers of W2;

prompting play whereupon the processor from the field selects an outcome set of numbers;

the processor comparing the numbers of the outcome set to the numbers of each way W1, W2 and if a correspondence exists, visually identifying the corresponding numbers; and the processor determining if for each way W1, W2 the number of numbers corresponding to the numbers of the outcome set corresponds to a winning outcome and if so, issuing an award to the player.

8. The method of claim 7 including the processor controlling the display to impose a first color to the numbers of way W1 and a second, different, color to the numbers of way W2.

9. The method of claim 7 including the numbers for the ways W1, W2 defining a total number set N and the processor determining if for the set N the number of numbers corresponding to the numbers of the outcome set corresponds to a winning outcome and if so, issuing an award to the player.

10. The method of claim 7 including for a number selected which is included in both ways W1, W2 defining a king number, the processor controlling the display to visually indicate that the king number is included in both ways W1, W2.

11. The method of claim 10 including the processor controlling the display to impose a first color to the numbers of way W1 and a second, different, color to the numbers of way W2 and to display the king number as including both of the first and second colors.

* * * * *